US009993090B2

(12) United States Patent
Hsu

(10) Patent No.: US 9,993,090 B2
(45) Date of Patent: Jun. 12, 2018

(54) HOOK-ON CHAIR

(71) Applicant: WEI GUAN HARDWARE (SHENZHEN) CO., LTD., Shenzhen (CN)

(72) Inventor: Chuan Kai Hsu, Shenzhen (CN)

(73) Assignee: KIDS II, INC., Atlanta, GA (US)

( * ) Notice: Subject to any disclaimer, the term of this patent is extended or adjusted under 35 U.S.C. 154(b) by 0 days. days.

(21) Appl. No.: 15/470,354

(22) Filed: Mar. 27, 2017

(65) Prior Publication Data

US 2017/0280890 A1 Oct. 5, 2017

(30) Foreign Application Priority Data

Mar. 30, 2016 (CN) ..... 2016 2 0254834

(51) Int. Cl.
*A47D 1/10* (2006.01)

(52) U.S. Cl.
CPC ..... *A47D 1/106* (2013.01)

(58) Field of Classification Search
CPC ..... A47D 1/106
USPC ..... 297/174 CS
See application file for complete search history.

(56) References Cited

U.S. PATENT DOCUMENTS 3,977,722 A 8/1976 Gist
4,230,362 A 10/1980 Euwema et al.
4,248,478 A 2/1981 Aron
4,312,535 A 1/1982 Smith
4,322,110 A 3/1982 Simmons et al.
4,362,333 A 12/1982 Cohen
4,415,200 A 11/1983 Bourne
4,469,373 A 9/1984 Simmons et al.
4,506,928 A 3/1985 Marion
4,530,539 A 7/1985 Gaber et al.
4,548,440 A 10/1985 Meslin et al.
4,568,120 A 2/1986 Hoffman
4,585,271 A 4/1986 Wu
4,586,746 A 5/1986 Day et al.
4,629,247 A 12/1986 Wu
4,818,016 A 4/1989 Mariol et al.
4,844,537 A 7/1989 Reed
4,863,216 A 9/1989 Prescott
5,348,374 A 9/1994 Kuo
5,415,456 A 5/1995 Hart et al.
5,470,127 A 11/1995 Kassai et al.
5,480,211 A 1/1996 Douglas et al.
6,273,503 B1 * 8/2001 Cheng ..... A47D 1/106 297/174 CS
6,679,549 B2 * 1/2004 Catelli ..... A47D 1/106 297/174 CS
6,736,451 B1 5/2004 Chen
7,591,506 B2 9/2009 Flannery
7,621,592 B1 11/2009 Flannery
7,651,161 B2 1/2010 Anselmi et al.
7,845,719 B2 12/2010 Flannery
8,038,207 B2 10/2011 Flannery
(Continued)

*Primary Examiner* — Anthony D Barfield
(74) *Attorney, Agent, or Firm* — Gardner Groff Greenwald & Villanueva, PC

(57) ABSTRACT

A children's dining chair, such as for example a hook-on children's dining chair for hooking onto or otherwise attaching to a table or other support, with an improved structure and better performance. In example embodiments, the present invention further provides a hook-on chair with an enhanced clamping force.

5 Claims, 9 Drawing Sheets

(56) References Cited

U.S. PATENT DOCUMENTS

| | | | | |
|---|---|---|---|---|
| 8,210,610 | B2 | 7/2012 | Berkey et al. | |
| 8,297,694 | B2 | 10/2012 | Arnold, IV et al. | |
| 8,360,514 | B2 | 1/2013 | Chen et al. | |
| 8,678,491 | B2 | 3/2014 | Chen et al. | |
| 9,101,227 | B2 | 8/2015 | Zehfuss | |
| 9,161,636 | B2 | 10/2015 | Opsvik et al. | |
| 2009/0243349 | A1* | 10/2009 | Flannery ..... | A47D 1/106 297/174 CS |
| 2010/0038936 | A1* | 2/2010 | Gibson ..... | A47D 1/106 297/174 CS |

* cited by examiner

HOOK-ON CHAIR

CROSS-REFERENCE TO RELATED APPLICATION

This application claims the priority benefit of Chinese Mainland Utility Model Patent Application No. 201620254834.X filed Mar. 30, 2016, the entirety of which is hereby incorporated herein by reference for all purposes.

TECHNICAL FIELD

The present invention relates generally to a hook-on chair for babies and young children.

BACKGROUND

Examples of known baby dining chairs are made up of several panels or boards, and may be of the same height as the tabletop for the convenience of parental care. A restaurant usually has a number of baby dining chairs. However, these chairs are often large and space-inefficient, and affect overall appearance. For households, it would be desirable for a baby dining chair to be foldable and portable to be carried along. However, small hook-on chairs currently available on the market commonly have a limited clamping force at the edge of the table, and may be likely to loosen, thereby affecting their practicality.

Accordingly, it can be seen that needs exist for a hook-on children's dining chair with an improved structure and better performance. It is to the provision of an improved children's dining chair a meeting these and other needs that the present invention is primarily directed.

SUMMARY

In example embodiments, the present invention provides an improved children's dining chair, such as for example a hook-on children's dining chair for hooking onto or otherwise attaching to a table or other support, with an improved structure and better performance. In example embodiments, the present invention further provides a hook-on chair with an enhanced clamping force.

In example embodiments, the invention relates to a hook-on chair, comprising a main plate and an outer plate. When it rises to a preset height via the moving rod, the pressing block is pressed against the bottom surface of the table. If the user wants to further reduce the spacing between the nonslip cover and the nonslip pad, the turning handle can be operated to turn outward, and its pushing end pushes away the lifting block upward, so that the lifting block drives the rotating plate to rise. Since the plate teeth of the rotating plate are engaged with the rod teeth of the moving rod, the rotating plate further drives the moving rod to move up, thereby reducing the spacing between the nonslip cover and the nonslip pad to increase the clamping force, so that the frame can be mounted at the edge of the table more securely, making it a very advanced product.

In one aspect, an example embodiment of a hook-on chair according to the present invention includes a lever, a pressing member, a moving rod and a turning handle. Both ends of the lever of said frame may be fitted with a sleeve each, a nonslip cover is preferably provided at the front end of each sleeve, and a bottom bar extends in the rear part of each sleeve, and the other end of said bottom bar is connected with the main body of a pressing member. The pressing member preferably includes a main body an engaging block, a lifting block, a rotating plate and a sliding bush. The main body is preferably fixed at one end of said bottom bar, a through hole is provided in the front part of said main body, and the rod body of a moving rod is inserted in said through hole. An engaging block is provided inside said main body, several engaging teeth are provided on the side of said engaging block, and said engaging teeth are engaged with the button teeth of a turning handle. A lifting block is provided above said engaging block, a lifting spring is provided between said lifting block and said main body, and one end of said lifting block is pivoted on a rotating plate. Several plate teeth are provided on one said of said rotating plate, said plate teeth are engaged with rod teeth, and a leaf spring is provided between said rotating plate and said lifting block, so that said rotating plate can be pushed toward said moving rod, a long slot is opened on said rotating plate, the hook end of a sliding bush is embedded in said long slot and extends from one side of a sliding bush, and said sliding bush is fitted over said bottom bar to drive said rotating plate to rotate. The moving rod preferably includes a rod body and a pressing block, said rod body runs through said through hole, and several rod teeth are provided on one side of said rod body. A pressing block is formed on the top of said rod body, and a nonslip pad is provided on the top of said pressing block. The turning handle preferably includes a handle, a button and a pushing end. The handle is pivoted inside said main body, a button is pivoted inside said handle, said button has several button teeth, which are engaged with said engaging teeth. A button spring is provided between said button and said handle, a pushing end is formed on the top of said handle, and said pushing end can be pressed against said lifting block.

Therefore, in this structure, when the moving rod rises to a preset height via the moving rod, the pressing block is pressed against the bottom surface of the table. If the user wants to further reduce the spacing between the nonslip cover and the nonslip pad, the turning handle can be operated to turn outward, and its pushing end pushes away the lifting block upward, so that the lifting block drives the rotating plate to rise. Since the plate teeth of the rotating plate are engaged with the rod teeth of the moving rod, the rotating plate further drives the moving rod to move up, thereby reducing the spacing between the nonslip cover and the nonslip pad to increase the clamping force, so that the frame can be mounted at the edge of the table more securely, making it a very advanced product.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

INDEX OF REFERENCE NUMBERS

Figure 1:
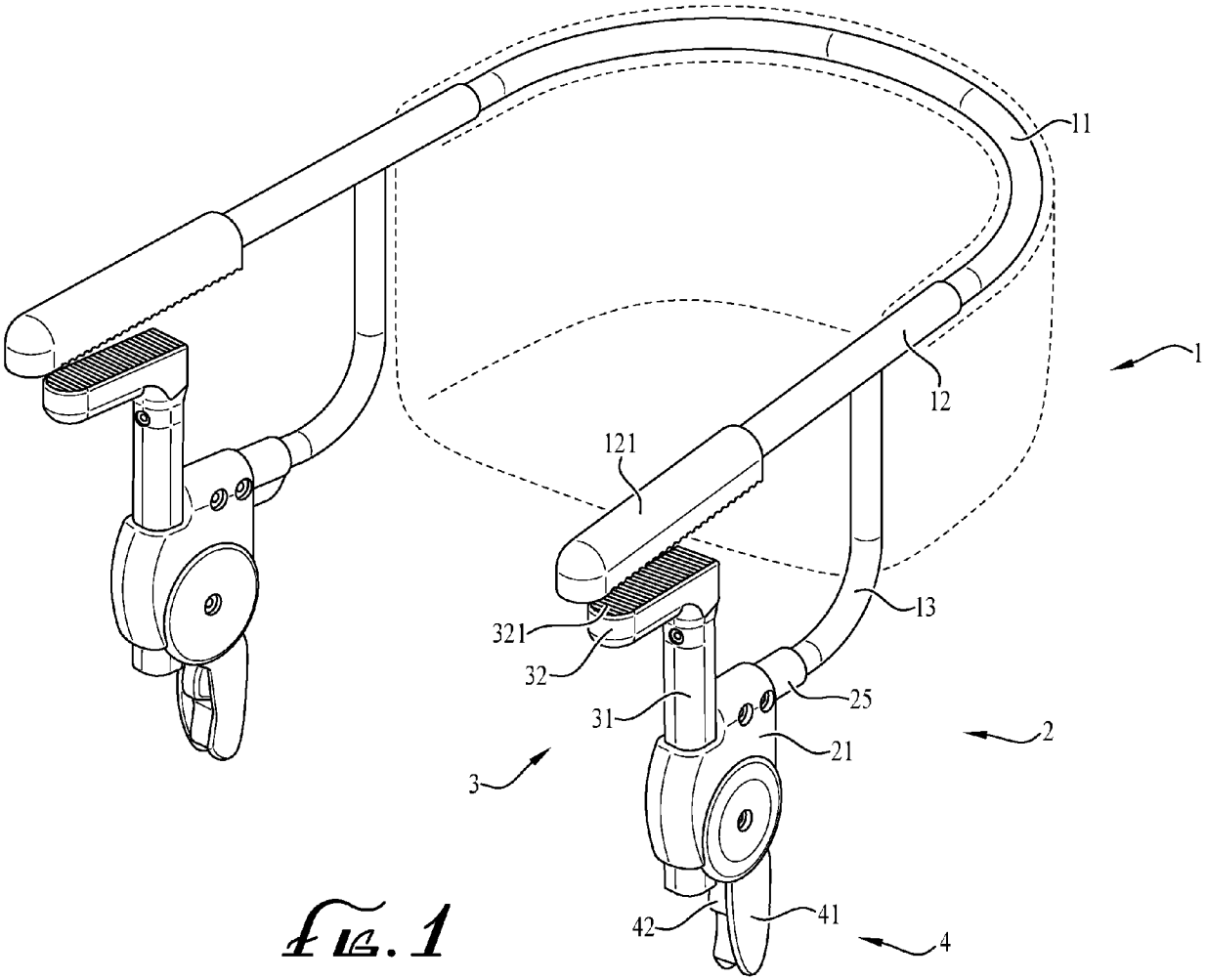
FIG. 1 is a three-dimensional schematic diagram of a hook-on chair according to an example embodiment of the present invention.

The following is an index of reference numbers as enumerated in the drawing figures:

1 Frame
11 Lever
12 Sleeve
121 Nonslip cover
13 Bottom bar
2 Pressing member
21 Main body
211 Through hole
212 Main body slot
22 Engaging block
221 Engaging teeth
23 Lifting block
231 Lifting spring
232 Lifting groove
233 Lifting side groove
24 Rotating plate
241 Plate teeth
242 Leaf spring
243 Long slot
244 Plate tenon
25 Sliding bush
251 Hook end
3 Moving rod
31 Rod body
311 Rod teeth
32 Pressing block
321 Nonslip pad
4 Turning handle
41 Handle
411 Handle tenon
42 Button
421 Button teeth
422 Button spring
423 Button notch
43 Pushing end

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present utility model relates to a hook-on chair, (referring to FIG. 1 and FIG. 2), comprising: A frame (1), comprising a lever (11), a sleeve (12) and a bottom bar (13), where said lever (11) is U-shaped, and can fit with a chair for babies and young children, both ends of said lever (11) are fitted with a sleeve (12) each, a nonslip cover (121) is provided at the front end of each sleeve (12), and a bottom bar (13) extends in the rear part of each sleeve (12), and the other end of said bottom bar (13) is connected with the main body (21) of a pressing member (2). A seat portion, for example formed of fabric or other soft goods is supported by attachment to the lever (11) or rear cantilevered frame portion of the seat frame (1), indicated in broken lines in FIG. 1, for example in the nature of a sling or seat-well, for positioning a child seated therein.

Figure 2:
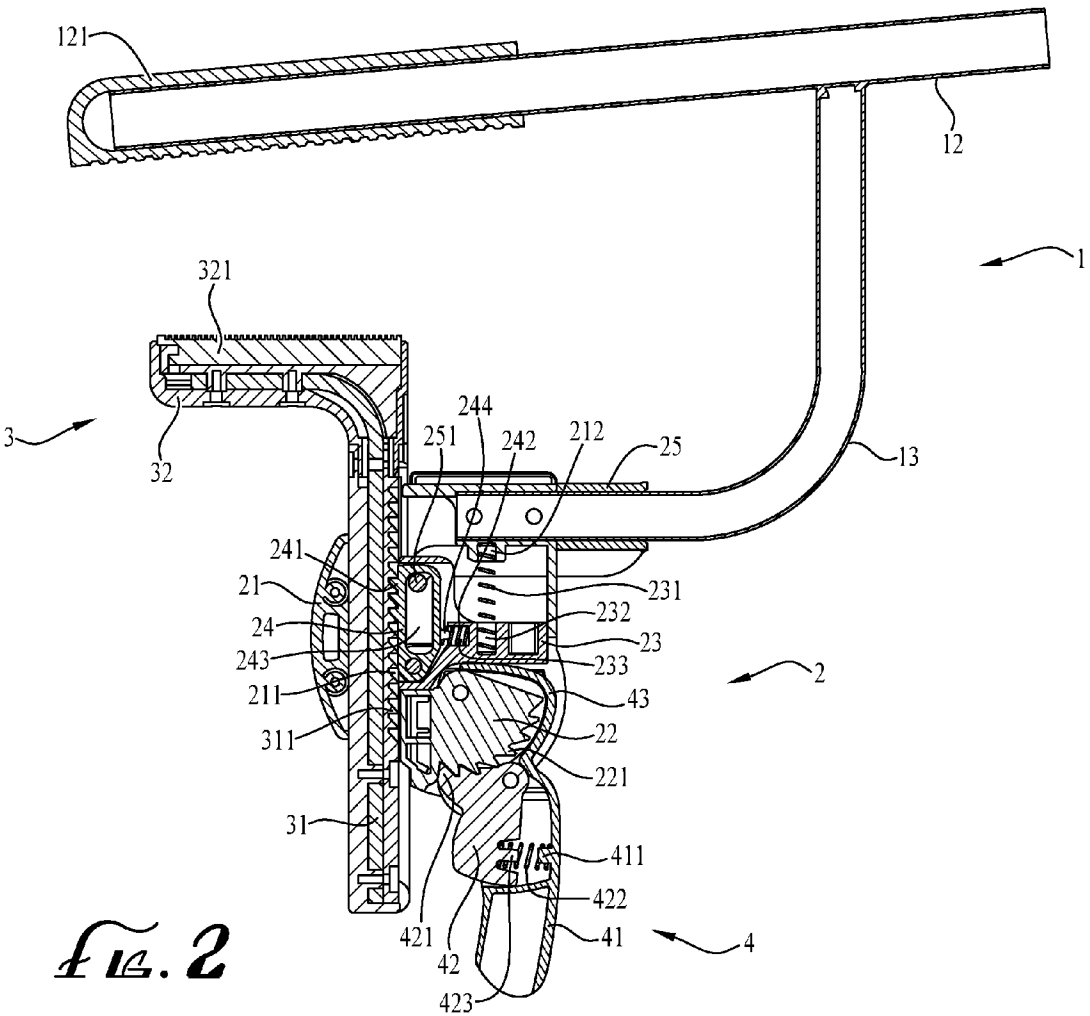
FIG. 2 is a sectional view of a hook-on chair according to an example embodiment of the present invention.

Referring to FIG. 1 and FIG. 2, said pressing member (2) comprises a main body (21) an engaging block (22), a lifting block (23), a rotating plate (24) and a sliding bush (25), said main body (21) is fixed at one end of said bottom bar (13), a through hole (211) is provided in the front part of said main body (21), the rod body (31) of a moving rod (3) is inserted in said through hole (211), an engaging block (22) is provided inside said main body (21), several engaging teeth (221) are provided on the side of said engaging block (22), said engaging teeth (221) are engaged with the button teeth (421) of a turning handle (4), a lifting block (23) is provided above said engaging block (22), a lifting spring (231) is provided between said lifting block (23) and said main body (21), one end of said lifting block (23) is pivoted on a rotating plate (24), several plate teeth (241) are provided on one said of said rotating plate (24), said plate teeth (241) is engaged with rod teeth (311), a leaf spring (242) is provided between said rotating plate (24) and said lifting block (23), so that said rotating plate (24) can be pushed toward said moving rod (3), a long slot (243) is opened on said rotating plate (24), the hook end (251) of a sliding bush (25) is embedded in said long slot (243) and extends from one side of a sliding bush (28), and said sliding bush (28) is fitted over said bottom bar (21) to drive said rotating plate (24) to rotate.

Said moving rod (3) comprises a rod body (31) and a pressing block (32), said rod body (31) runs through said through hole (211), several rod teeth (311) are provided on one side of said rod body (31), a pressing block (32) is formed on the top of said rod body (31), and a nonslip pad (321) is provided on the top of said pressing block (32).

Said turning handle (4) comprises a handle (41), a button (42) and a pushing end (43), said handle (41) is pivoted inside said main body (21), a button (42) is pivoted inside said handle (41), said button (42) has several button teeth (421), which are engaged with said engaging teeth (221), a button spring (422) is provided between said button (42) and said handle (41), a pushing end (43) is formed on the top of said handle (41), and said pushing end (43) can be pressed against said lifting block (23).

Figure 3:
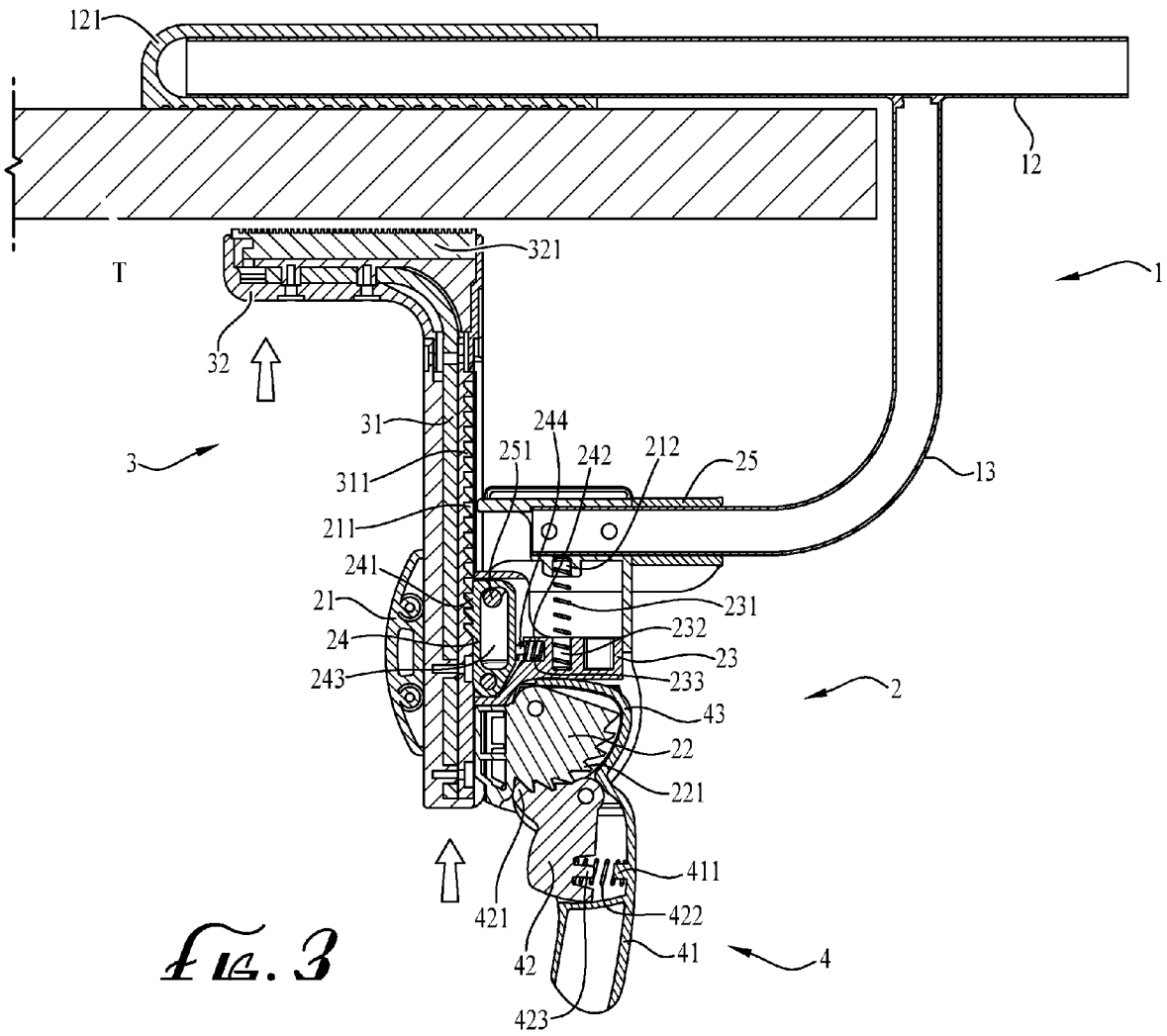
FIG. 3 is a schematic diagram of upward pushing of the moving rod in the hook-on chair according to an example embodiment of the present invention.

As an example embodiment and method of operation of the hook-on chair of the present utility model (referring to FIG. 3), the user may press said nonslip cover (121) of each of the two frames on the top of the table T, and then push said moving rod (3) upward. By virtue of the engagement between said plate teeth (241) and said rod teeth (311), said rod body (31) can be fixed at a preset height, so that said nonslip pad (321) on said pressing block (32) is pressed against the bottom surface of the table, so that said frame (1) can be fixed at the edge of the table via the clamping force between said nonslip cover (121) and said nonslip pad (321).

Figure 4:
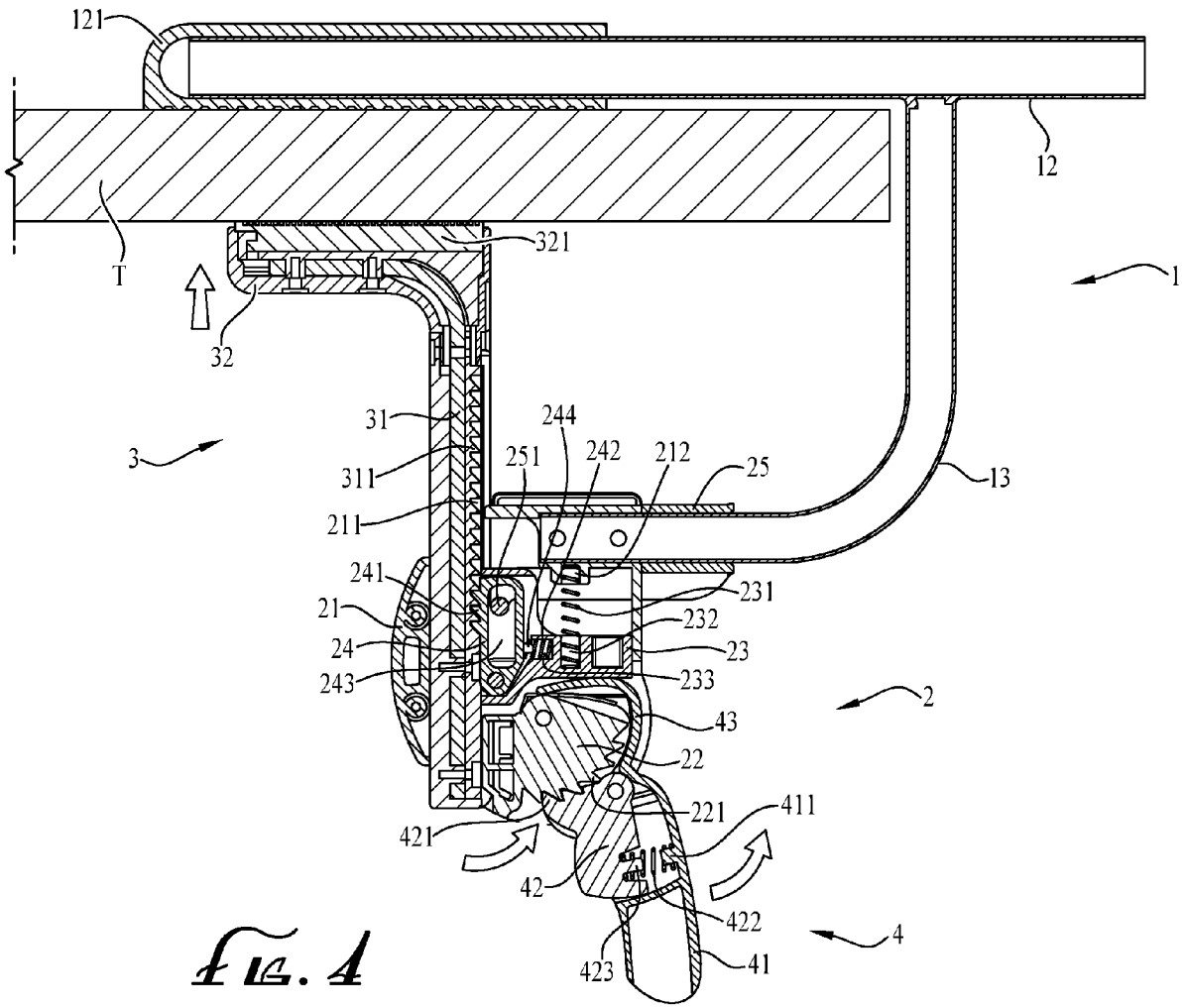
FIG. 4 is a schematic diagram of outward pulling of the turning handle in the hook-on chair according to an example embodiment of the present invention.
Figure 5:
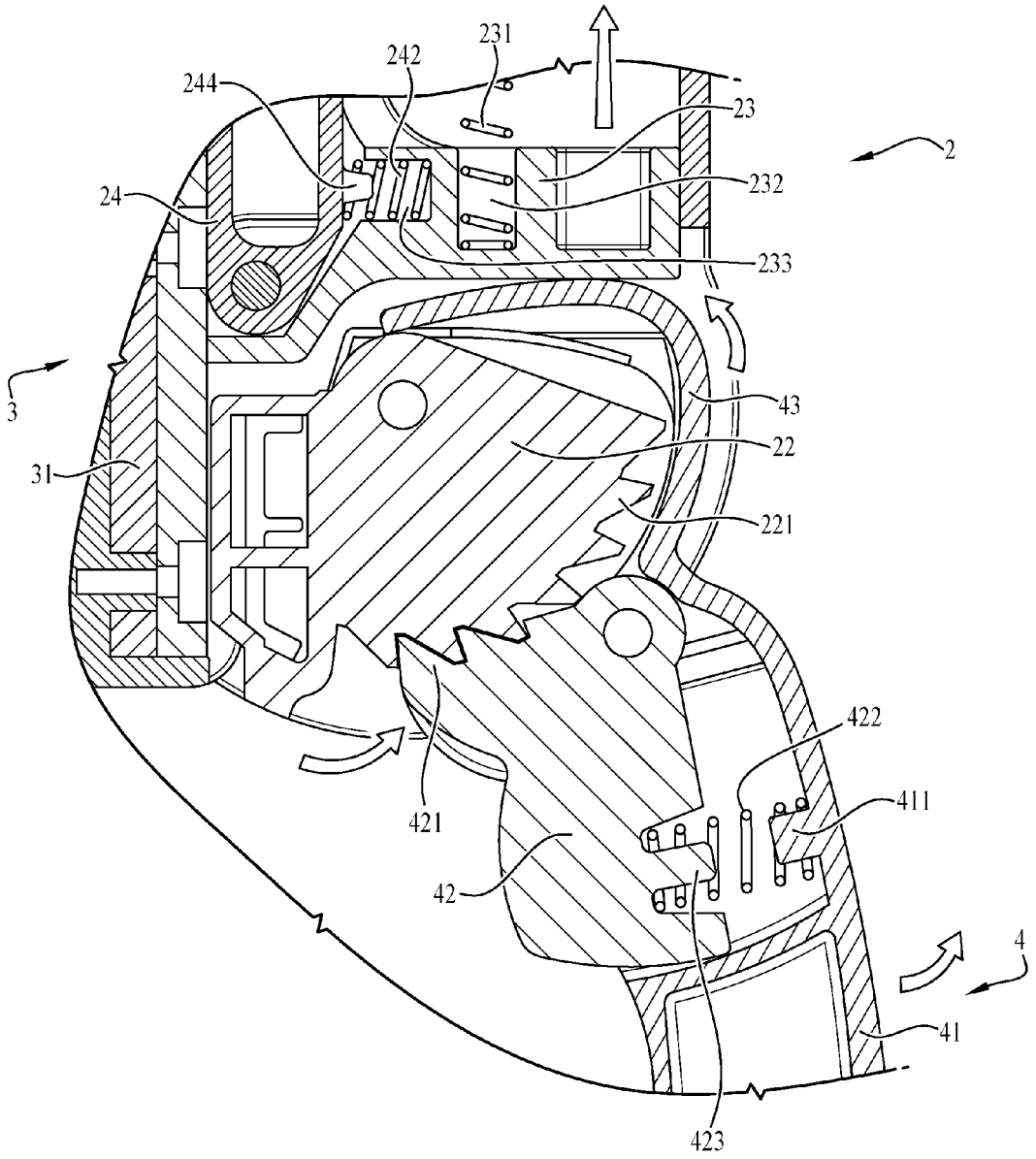
FIG. 5 is an enlarged sectional view of the lifting block moving up in the hook-on chair according to an example embodiment of the present invention.

If the user is to increase the clamping force between said nonslip cover (121) and said nonslip pad (321) (referring to FIG. 4 and FIG. 5), the user may push said handle (41) of said turning handle (4) outward, so that said button teeth (421) of said button (42) are embedded into the engaging tooth (221) of the next position of said engaging block (22) to fix the rotation angle of said handle (41). When said handle (41) turns outward, said pushing end (43) of said handle (41) can push said lifting block (23) upward, while said hook end (251) of said sliding bush (25) drops in said long slot (243). When said lifting block (23) rises, said lifting block (23) drives said rotating plate (24) to rise. Since said plate teeth (241) of said rotating plate (24) are engaged on said rod teeth (311), said rotating plate (24) further drives said moving rod (3) to move up, so that said pressing block (32) can be pressed tightly against the bottom surface of the table, and said frame (1) can be mounted on the edge of the table more securely.

Figure 6:
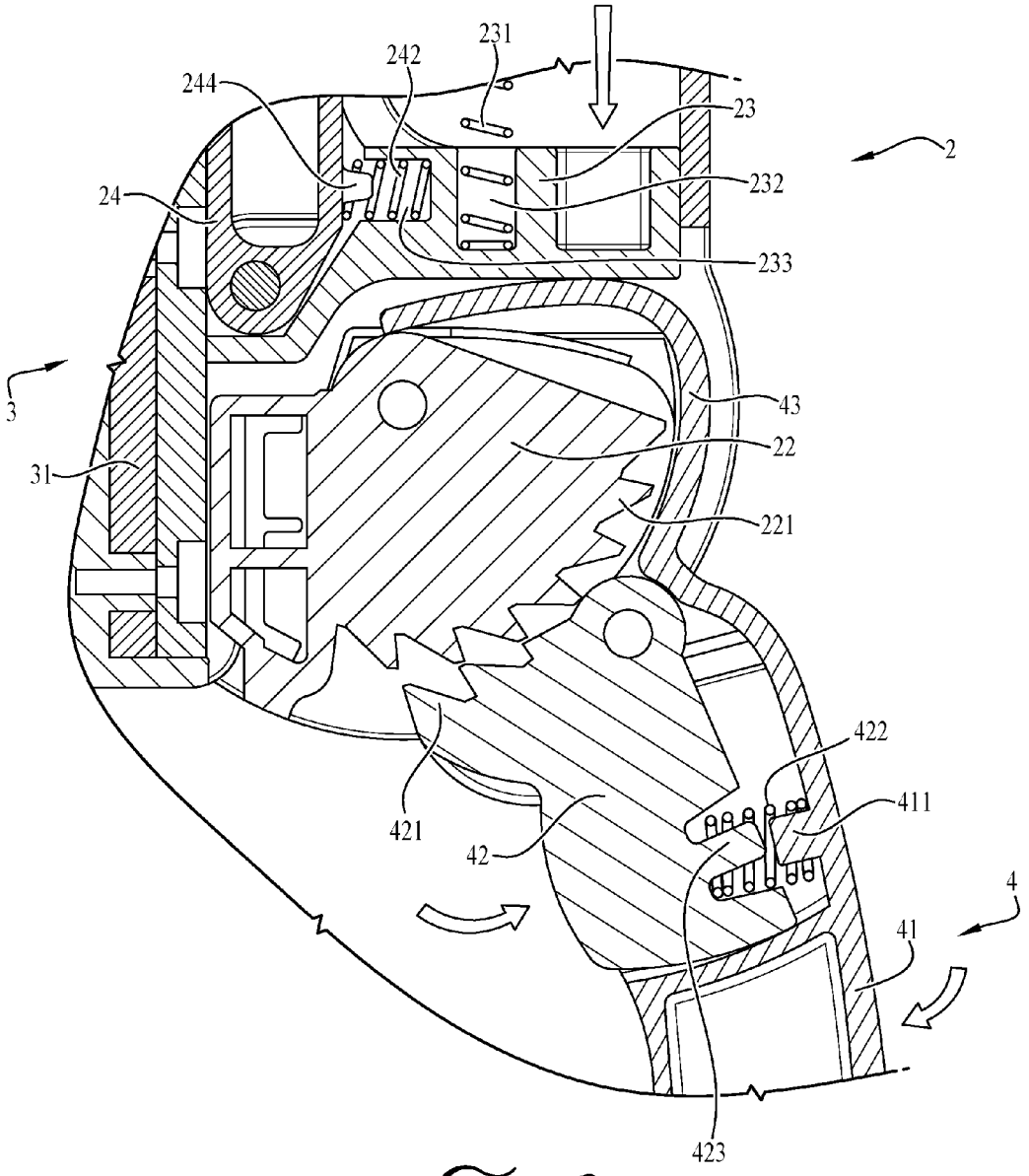
FIG. 6 is an enlarged sectional view of the button teeth disengaged from the engaging teeth in the FIG. 7 is an enlarged sectional view of the rotating plate being pulled by the hook end of the sliding bush in the hook-on chair according to an example embodiment of the present invention.
Figure 8:
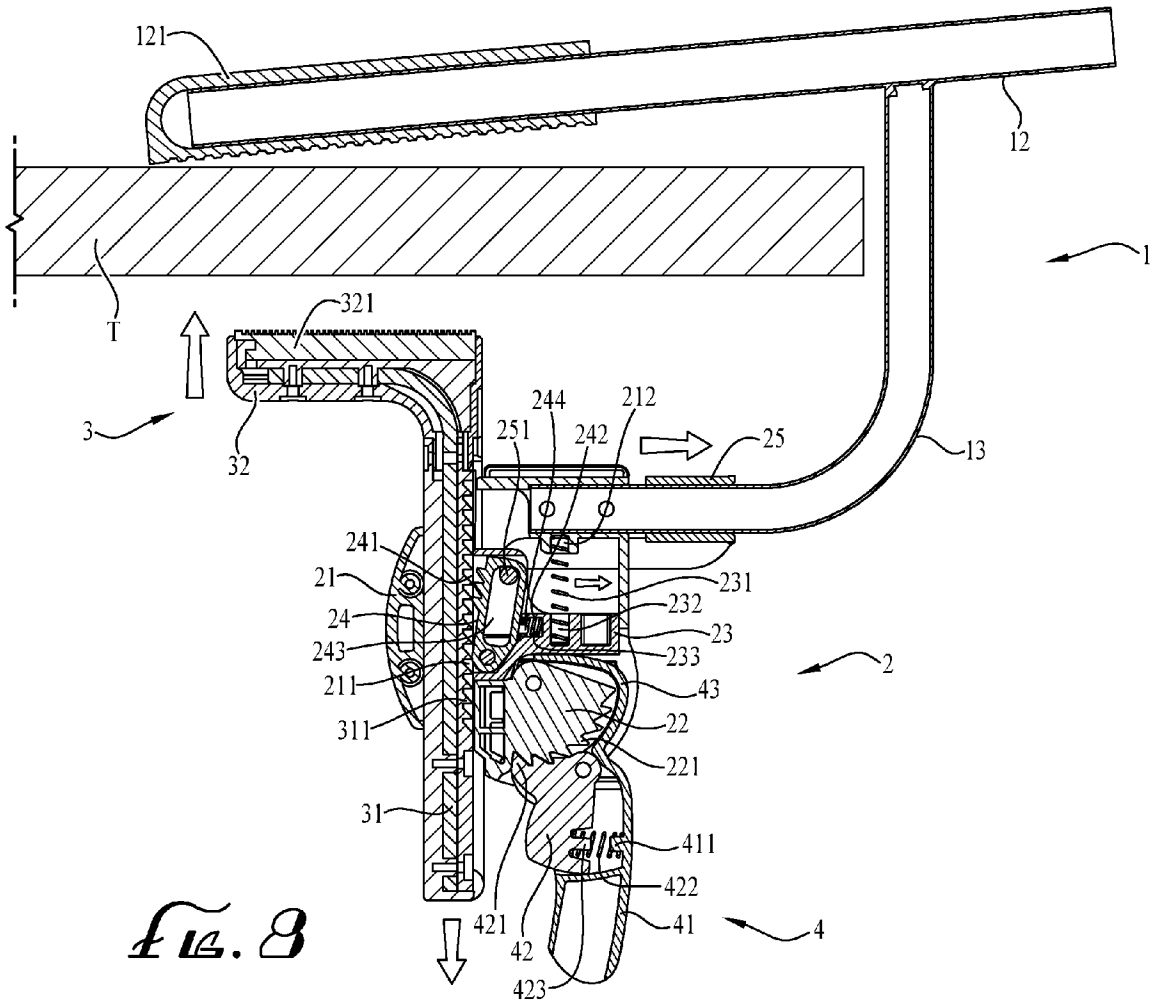
FIG. 8 is a schematic diagram of dropping of the moving rod in the hook-on chair according to an example embodiment of the present invention.

Referring to FIG. 6 and FIG. 8, if said frame (1) is to be removed from the edge of the table, said button (42) on said turning handle (4) can be pressed, so that said button teeth (421) on said button (42) are disengaged from said engaging teeth (221) to turn said handle (41) inward. When said handle (41) turns inward, said pushing end (43) is disengaged from said lifting block (23), which is pushed down by said lifting spring (231), so that said moving rod (3) drops slightly.

Figure 7:
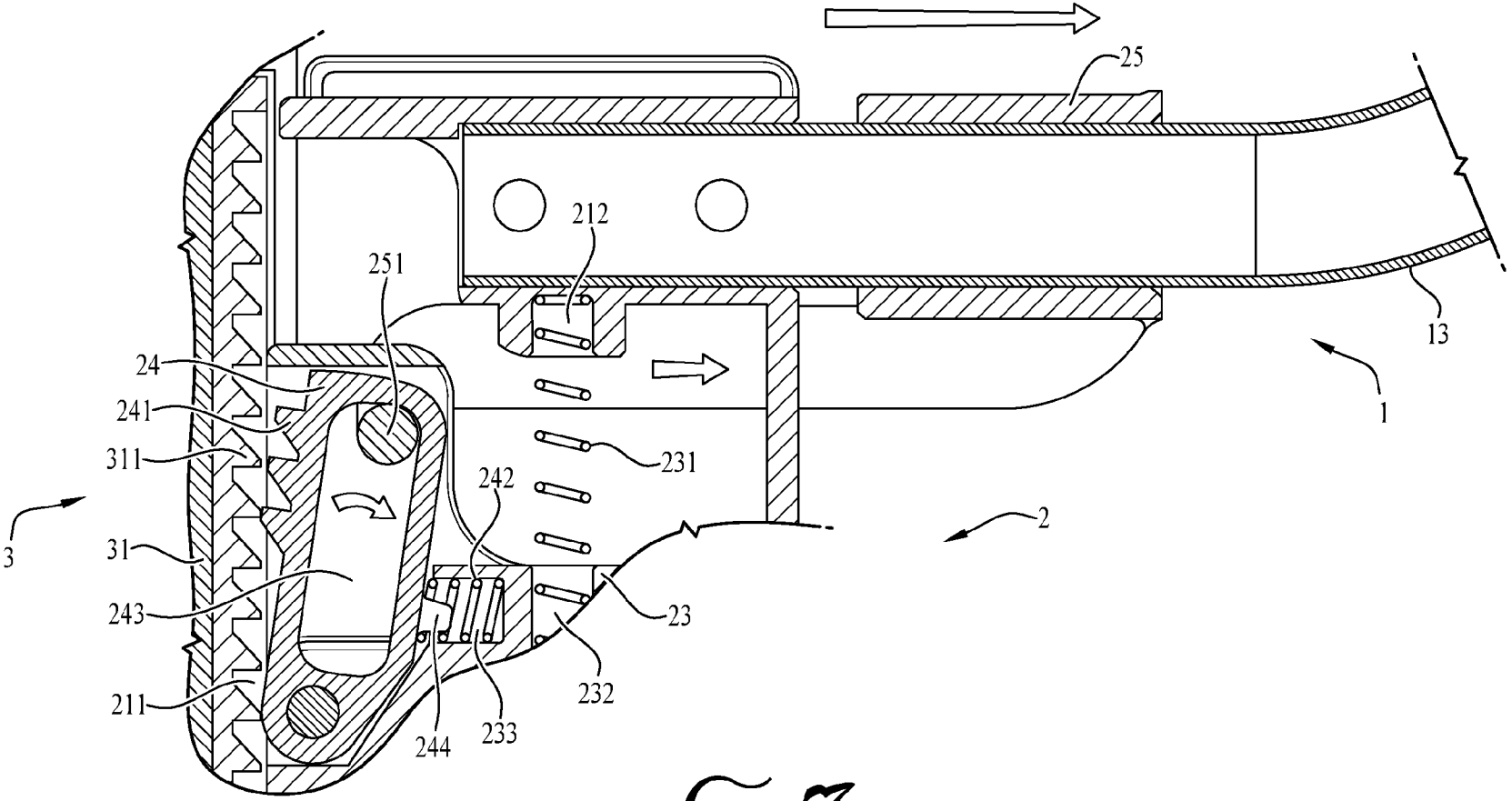

Referring to FIG. 7 and FIG. 8, then, the user can push said sliding bush (25) outward, so that said hook end (251) of said sliding bush (25) is pushed away from said rotating plate (24), and said rotating plate (24) turns to one side. When said rotating plate (24) rotates, said plate teeth (241) is disengaged from said rod teeth (311) of said moving rod (3), so that said moving rod (3) is disengaged and drops, completing the motion of disassembling the hook-on chair.

Referring to FIG. 2, said engaging teeth (221) and plate teeth (241) of said pressing member (2), said rod teeth (311) of said moving rod (3) and said button teeth (421) of said turning handle (4) are all skewed teeth, said lifting spring (231) is mounted between said main body slot (212) and said lifting groove (232), said main body slot (212) is provided on one side of the inner wall of said main body (21), said lifting groove (232) is provided on the top of said lifting block (23), said main body slot (212) corresponds to said lifting groove (232), said leaf spring (242) is provided between said plate tenon (244) and said lifting side groove (233), said plate tenon (244) is provided on one side of said rotating plate (24), said lifting side groove (233) is provided on one side of said lifting block (23), said plate tenon (244) corresponds to said lifting side groove (233), said button spring (422) is provided between said button notch (423) and said handle tenon (411), said handle tenon (411) is provided on one side of the inner wall of said handle (41), said button notch (423) is provided on one side of said button (42), and said handle tenon (411) corresponds to said button notch (423).

Figure 9:
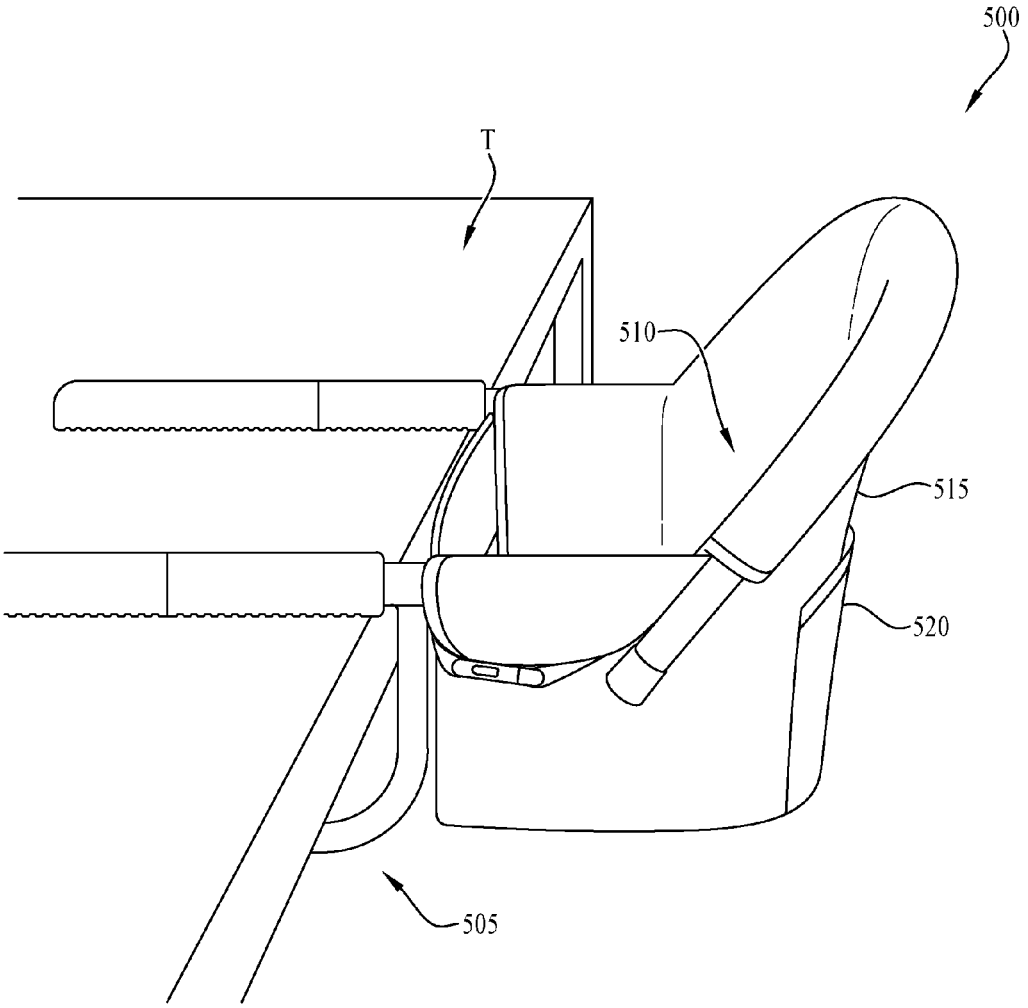
FIG. 9 shows a hook-on chair according to another example embodiment of the present invention.

FIG. 9 shows a hook-on chair or child seat 500 for attachment to a table T according to another example embodiment of the present invention. The chair 500 comprises a support frame including a clamping or mounting portion 505 for secure but releasable attachment to the table T, in similar fashion to the previously described embodiment. The chair 500 further comprises a seat portion, for example a fabric or soft goods seat 510 supported by the frame, and defining a seat-well or receiver configured to receive a child seated therein. The seat 510 optionally includes a base or lower support surface upon which the child sits, first and second side panels or armrest portions extending generally upright from opposite sides of the lower support surface, a seatback portion 515 for example in the form of an obliquely inclined generally upright back panel extending upwardly from the back of the lower support surface between the side panels, and a front portion with leg openings extending upwardly from the front of the lower support surface between the side panels. Optionally one or more retention straps or harness elements are provided for securing the child in the seat. A storage pocket 520 is optionally also provided on the exterior of the seatback 515, or positioned elsewhere on the seat 500.

The hook-on chair of the present utility model is characterized in that in this structure, when the moving rod rises to a preset height via the moving rod, the pressing block is pressed against the bottom surface of the table. If the user wants to further reduce the spacing between the nonslip cover and the nonslip pad, the turning handle can be operated to turn outward, and its pushing end pushes away the lifting block upward, so that the lifting block drives the rotating plate to rise. Since the plate teeth of the rotating plate are engaged with the rod teeth of the moving rod, the rotating plate further drives the moving rod to move up, thereby reducing the spacing between the nonslip cover and the nonslip pad to increase the clamping force, so that the frame can be mounted at the edge of the table more securely, making it a very advanced product.

While the invention has been described with reference to example embodiments, it will be understood by those skilled in the art that a variety of modifications, additions and deletions are within the scope of the invention, as defined by the following claims.

What is claimed is:

1. A hook-on chair, comprising:

a frame, comprising a lever, a sleeve and a bottom bar, wherein said lever is U-shaped, and can fit with a chair for babies and young children, both ends of said lever are fitted with a sleeve each, a nonslip cover is provided at the front end of each sleeve, and a bottom bar extends in the rear part of each sleeve, and the other end of said bottom bar is connected with the main body of a pressing member;

a turning handle comprising a handle, a button pivoted inside said handle, and a pushing end, said button comprising several button teeth; and a moving rod comprising a rod body, a pressing block on top of said rod body, and a nonslip pad on top of said pressing block, wherein several rod teeth are provided on one side of said rod body;

wherein said pressing member comprises a main body, an engaging block, a lifting block, a rotating plate and a sliding bush, said main body is fixed at one end of said bottom bar, a through hole is provided in the front part of said main body, the rod body of the moving rod is inserted in said through hole, an engaging block is provided inside said main body, several engaging teeth are provided on the side of said engaging block, said engaging teeth are engaged with the button teeth, a lifting block is provided above said engaging block, a lifting spring is provided between said lifting block and said main body, one end of said lifting block is pivoted on a rotating plate, several plate teeth are provided on one side of said rotating plate, said plate teeth is engaged with rod teeth, a leaf spring is provided between said rotating plate and said lifting block, so that said rotating plate can be pushed toward said moving rod, a long slot is opened on said rotating plate, the hook end of a sliding bush is embedded in said long slot and extends from one side of a sliding bush, and said sliding bush is fitted over said bottom bar to drive said rotating plate to rotate;

wherein said handle is pivoted inside said main body, a button spring is provided between said button and said handle, a pushing end is formed on the top of said handle, and said pushing end can be pressed against said lifting block.

2. A hook-on chair according to claim 1, wherein said engaging teeth and plate teeth of said pressing member, said rod teeth of said moving rod, and said button teeth of said turning handle are skewed teeth.

3. A hook-on chair according to claim 1, wherein a main body slot is provided in the inner wall of said main body of said pressing member, a lifting groove is provided on the top of said lifting block and corresponds to said main body slot, and said lifting spring is provided between said main body slot and said lifting groove.

4. A hook-on chair according to claim 1, wherein a plate tenon is provided on one side of said rotating plate of said pressing member, a lifting side groove is provided on one end of said lifting block and corresponds to said plate tenon, and said leaf spring is provided between said plate tenon and said lifting side groove.

5. A hook-on chair according to claim 1, wherein a handle tenon is provided on one side of the inner wall of said turning handle, a button notch is provided on one side of said button and corresponds to said handle tenon, and said button spring is provided between said button notch and said handle tenon.

* * * * *